United States Patent [19]

Ausnit

[11] 4,107,870

[45] Aug. 22, 1978

[54] SEPARABLE CONNECTIVE FLEXIBLE TOY ASSEMBLY

[76] Inventor: Steven Ausnit, 124 E. 61st St., New York, N.Y. 10021

[21] Appl. No.: 722,722

[22] Filed: Sep. 13, 1976

[51] Int. Cl.[2] ..... A63H 33/08

[52] U.S. Cl. ..... 46/28; 24/201 C; 24/203 R; 29/416; 29/450; 46/30; 403/207; 403/346

[58] Field of Search ..... 46/30, 31, 28, 29, 27, 46/25, 23, 18; 24/17 A, 17 R, 16 R, 203, 201 C; 428/8, 11; 29/DIG. 47, 417, 416, 450, 453; 132/44; 403/207, 346

[56] References Cited

U.S. PATENT DOCUMENTS

| | | | |
|---|---|---|---|
| 902,695 | 11/1908 | Staley | 24/17 A |
| 1,945,932 | 2/1934 | Caley | 29/453 X |
| 1,980,843 | 11/1934 | Andrews | 24/17 A |
| 3,604,145 | 9/1971 | Zimmerman | 46/30 X |

FOREIGN PATENT DOCUMENTS

| | | | |
|---|---|---|---|
| 1,331,581 | 5/1963 | France | 403/346 |
| 931,491 | 10/1947 | France | 46/29 |
| 380,422 | 9/1964 | Switzerland | 24/201 C |
| 12,577 | 5/1914 | United Kingdom | 24/17 A |
| 383,585 | 11/1932 | United Kingdom | 46/29 |

*Primary Examiner*—F. Barry Shay
*Attorney, Agent, or Firm*—Hill, Gross, Simpson, Van Santen, Steadman, Chiara & Simpson

[57] ABSTRACT

A separably connective flexible toy assembly comprises a plurality of generally flat elongated geometric flexible toy members each of which has at its opposite ends complementary fastener means, at least one of the members having a slit intermediate its length through which another of the members may project whereby to provide a multi-arm configuration, each of the arms being bendable and twistable along its length such that the fastener ribs and grooves of the arm ends are interlockable with fastener ribs and grooves of another arm end of the same member or of another member.

The members are particularly adapted to be made up from an extruded section formed from synthetic plastic material and severed to provide the individual members.

The assembly may be supplied as a kit having a plurality of separate members adapted to be assembled together by the user.

17 Claims, 13 Drawing Figures

SEPARABLE CONNECTIVE FLEXIBLE TOY ASSEMBLY

This invention relates in general to toys, and is more particularly concerned with separably connective flexible toys.

Numerous and various toys have heretofore been proposed or provided, generally of a rigid or semi-rigid construction even when made from plastics, and having various means for separable connection. Some toys have required application thereto of special connecting means. Other toys have had integral connecting means generally requiring special and often several forming dies, special machining, and the like. Insofar as I am aware, I am the first in this art to have provided a novel separably connective flexible toy structure comprising flexible sheet-like extended material separated into strips carrying integral fastener means at opposite ends of the strips adapted to be easily pressed together for separably connecting the toy members to one another, to each other, or to the members of other similar toys, in a large variety of combinations.

In my copending application Ser. No. 596,645 filed July 17, 1975, now U.S. Pat. No. 3,987,580, toys of this general nature have been disclosed and relatively broadly claimed, wherein the arms of the toy are bendable and twistable along their length and fastener ribs and grooves of the arm ends interlockable with fastener ribs and grooves of another arm end of the same member or of another member. According to that patent, the toys may be formed from extruded strips which are placed in crossing relation to one another and then welded or fused together. While this produces an excellent, durable and attractive toy, it does involve the substantial cost factor involved in labor and equipment for assembling and uniting the elements to produce the finished toy, reflected in the cost at which the toy must be priced for sale.

According to the present invention, the toy is adapted to be produced and sold at a substantially lower cost by supplying the toy in kit form wherein strip members having the separable fastenings at their opposite ends are provided in a form which the ultimate user may assemble, giving such user the opportunity to put together different colored strips, different numbers of strips and affording other variables for amusement and training in dexterity.

An important object of the present invention, therefore, is to provide a new and improved separably connective flexible toy which can be readily assembled by the ultimate user.

Another object of the invention is to provide a new and improved separably connective flexible toy which can be economically produced and sold at low cost.

According to features of the invention, a separably connective flexible toy is provided which comprises a plurality of generally flat elongated flexible toy strips each of which has complementary fastener rib and groove fastener means at the opposite ends, and means for separably interconnecting a plurality of the strips together intermediate their ends to provide a multi-arm toy assembly, each of the arms being bendable and twistable along its length and the fastener rib and groove means being at the ends of the arms and interlockable with fastener rib and groove means of another arm end of the same assembly or of another assembly.

Other features of the invention include means for assembling the strips comprising a slit in at least one of the strips through which one or more other strips are projectable.

According to additional features of the invention, the strips are adapted to be made from an extruded section prepunched to provide intermediate connecting slits for the strips and the strips then severed from the section.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which.

On referring to FIGS. 1–4, a representative multi-arm, generally star-shaped geometric toy form 15 comprises an assembly of a plurality of generally flat elongated flexible strips 17 formed from suitable plastic material and possessed of suitable resilient flexibility for the intended purpose. In the form shown, the toy 15 comprises an assembly of three of the strips 17, although a smaller or larger number of the strips may be employed, depending upon geometric and size preferences or the preferences of the person assembling the toy. The material of which the strips 17 are made may comprise suitable synthetic thermoplastic such as polyvinylchloride or polyethylene, which can be readily extruded.

Each of the strips 17 is of substantial width, having longitudinal edges and is of a length which is at least several times as great as the width. At each opposite end of each of the strips 17 it is provided with complementary fastener rib and groove means 18 of the type wherein each has a plurality of fastener ribs and complementary grooves extending transversely across the strip. The ribs are of generally hook-like profile providing undercut teeth facing into the contiguous grooves.

Figure 1:
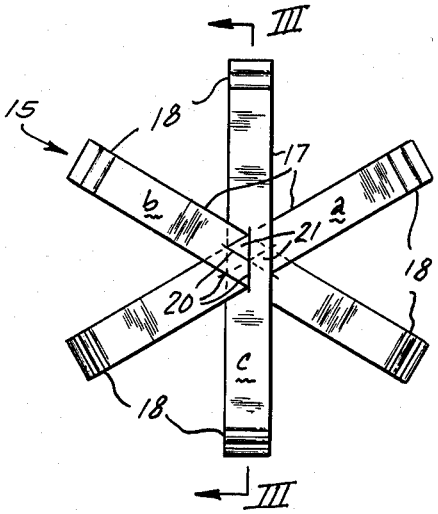
FIG. 1 is a plan view of a toy assembly embodying features of the invention.
Figure 2:
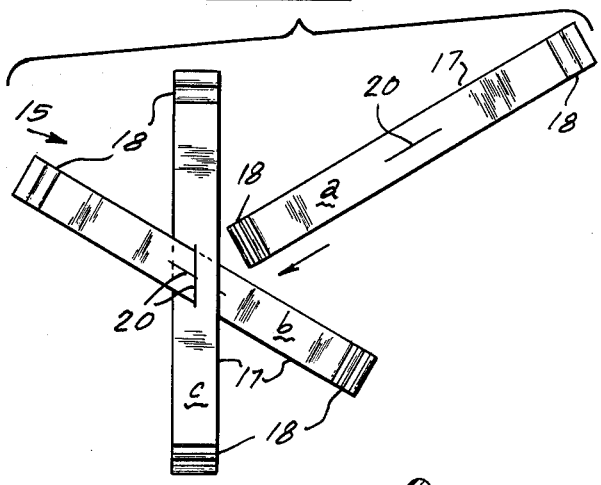
FIG. 2 is an assembly view demonstrating how the toy can be put together.
Figure 3:
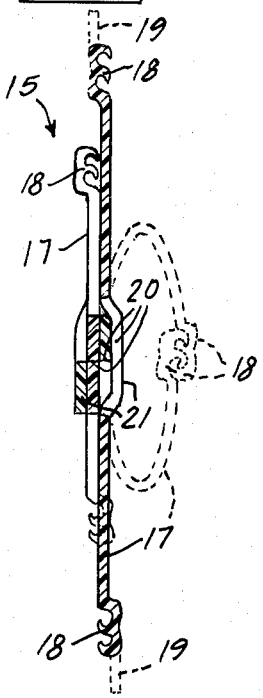
FIG. 3 is an enlarged section detail view taken substantially along the line III—III of FIG. 1.
Figure 4:
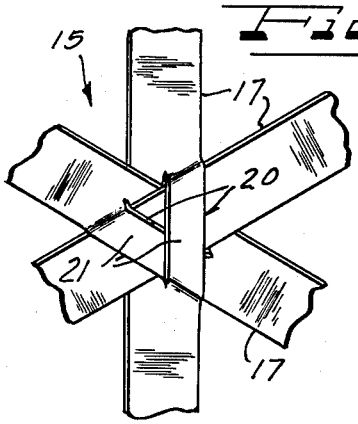
FIG. 4 is an enlarged isometric view of the central portion of the toy of FIG. 1.

The arrangement of the rib and groove fastener means 18 is such that they can be easily pressed together into interlocked relation for connecting members together, and are separable for disconnecting the members from one another by moving the interlocked members in opposite directions so that the ribs and grooves slide apart. The hook-like ribs are resiliently flexible so that they readily deform when the fastener means are pushed together so that the ribs drop into the complementary grooves wherein the ribs assume their unrestrained configuration and become interlocked with the undercut teeth of the complementary associated ribs. Depending on the resilient stiffness of the material, and the dimensions of the ribs and grooves, the interlocked engagement will persist with substantial resistance to pulling-apart separation, so that the members that are fastened together by means of the rib and groove fastener means will be effectively held together in the preferred connected orientation. However, when it is desired to disconnect the members from one another, the ribs and grooves of the fastener means 18 can be separated by moving one interlocked member in one direction and the other member in the opposite direction, thereby sliding them past each other into a disengaged mode. If preferred, of course, the strips 17 may be provided, as shown in FIG. 3, with lip-like extensions 19 which can be used to peel apart the interlocked ribs from the grooves containing them. These methods of engagement and disengagement allow the fastening means 18 to be securely interlocked yet remain relatively flat and have a gauge thickness of under 100 mils.

In a preferred construction, each of the strips 17 may be constructed identically so as to enable any one of the strips to be assembled with any similar strip to produce the toy configuration 15. To this end, each of the strips 17 has intermediate its ends, and preferably centrally thereof, a longitudinal slit 20 preferably midway between the longitudinal edges of the strip and of a length to permit free but restricted projection of another of the strips therethrough. For example, where the strips are of about one-quarter inch in width the length of the slits 20 may be about 5/16 to 3/8 of an inch in width. Through this arrangement, to assemble the toy 15, two or more of the strips 17 are joined by projecting one or more of the strips through the slit 20 of another of the strips serving as a master strip while the remaining strips are in slave relation thereto. For example, where three of the strips are used, two of them are projected into crossing relation through the slit 20 of one of the strips. To provide a firmer assembly, one of the crossing strips inserted into the slit 20 of the master strip is also interconnected with the other crossing strips extending through the master strip slit 20. This affords torsional stability, maintaining all three of the strips in an orientation wherein the arms of the strips which extend away from the center of the assembly are substantially equidistantly circumferentially spaced from one another. Because of the inherent resilience of the material of the strips 17, bands 21 of the strips separated by the slits 20 and relatively displaced from the normal plane of the strip of which they are a part by the projection of one or more of the other strips through the separating slit, are caused to react toward their normal plane and thus provide a frictional grip tending to hold the interposed, projected strips reasonably against displacement. This gripping effect is especially effective where strip *a* projects crossingly through the slit 20 of strip *b*, and the crossing portion of strips *a* and *b* project crossingly through the slit 20 of strip *c*. Thereby, the bands 21 of the strip *c* press against the bands 21 of the strip *b* which in turn press against the interposed strip *a*, resulting in a retaining grip maintaining the strips in the generally star-shaped orientation with sufficient firmness for the intended purpose, but permitting easy longitudinal adjustments of the strips, and when desired, separation of any one or more of the strips from one another.

After the strips 17 have been assembled into the toy 15, the arms of the toy may be secured together by means of the fasteners 18, wherein the arms of the same strip may be fastened together, as shown in dash outline in FIG. 3, or the arms of adjacent or other of the strips in the assembly may be fastened together to provide an interesting, ornamental loop arrangement wherein several of the toys may be secured together by looping them into assembly or some of the arms may be connected in loop arrangement and others attached to other of the toys 15, and so forth, throughout an interesting array of permutations, depending upon the dexterity and ingenuity of the user. Further interest is attained by the provision of different colors in the different strips so as to attain numerous and varied color combinations, teaching skill implementation, etc.

Figure 5:
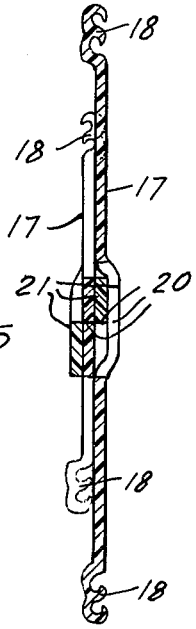
FIG. 5 is a sectional detail view substantially the same as FIG. 3 but showing a modification.

Whereas, as shown in FIG. 3, the ribs and grooves of the fasteners 18 may face in respectively opposite directions on the strip, as shown in FIG. 5 the fasteners may face in the same direction on each or some of the strips.

Figure 6:
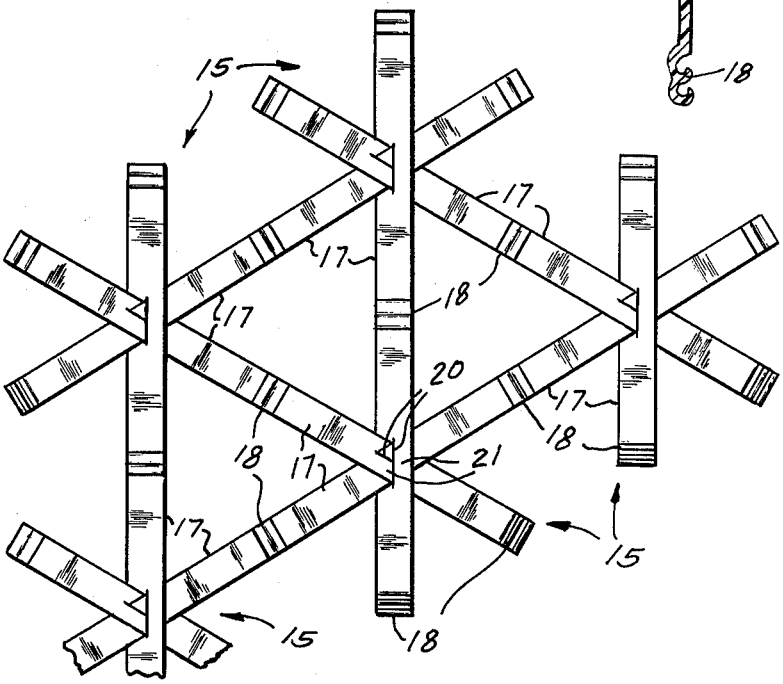
FIG. 6 is a plan view showing a plurality of the toy assemblies connected together.

As shown in FIG. 6, a plurality, in this instance five, of the toys have been connected together into an interesting geometrical pattern, representative of the numerous and varied effects that may be attained.

Figure 7:
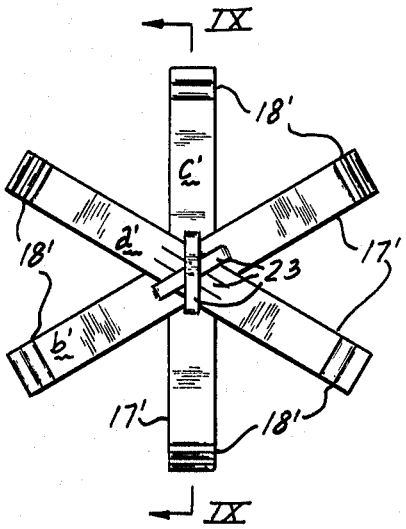
FIG. 7 is a plan view of a toy assembly similar to FIG. 1 but showing modification.
Figure 8:
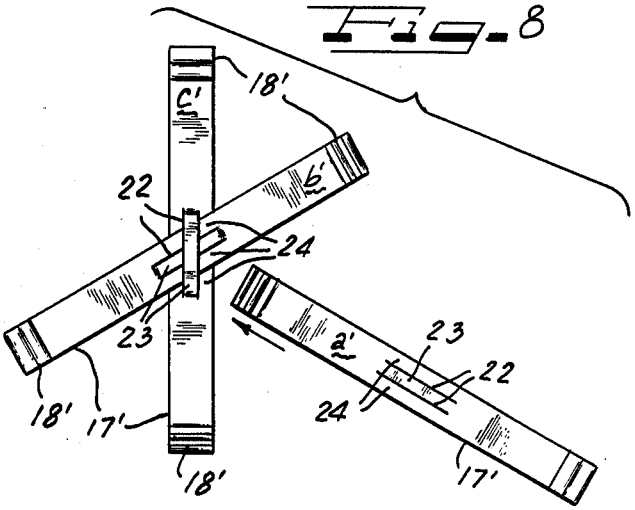
FIG. 8 is a plan view of the toy of FIG. 7 demonstrating a method of assembling the same.
Figure 9:
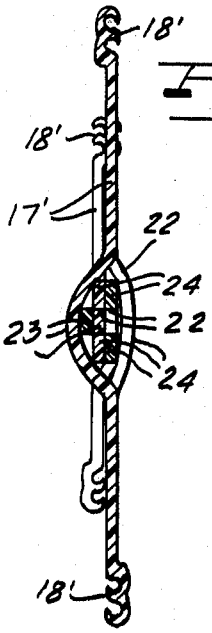
FIG. 9 is an enlarged sectional detail view taken substantially along the line IX—IX of FIG. 7.
Figure 10:
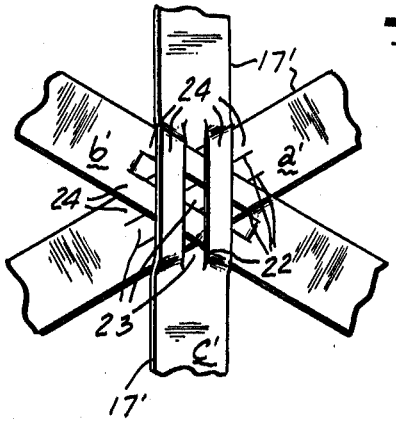
FIG. 10 is an enlarged isometric detail view of the central portion of the toy assembly of FIG. 7.
Figure 13:
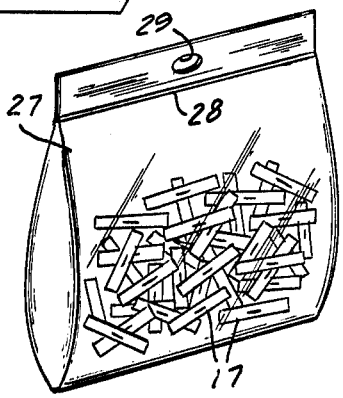
FIG. 13 is an isometric view of a kit in package form containing a plurality of strips for assembly into toys according to the present invention.

In a somewhat more challenging construction, as shown in FIGS. 7–10, each of the strips 17′, which may be of substantially similar construction as the strips 17 and provided with separable snap-together and slide-apart or pull-apart separable fastener means 18′ at the ends of the strips, have instead of single longitudinal centrally located connection slits, a pair of coextensive parallel slits 22, dividing the slit central area of the strip into a center band 23 and two side bands 24. This enables a more secure interconnection where a simple crossing assembled relation of two of the strips is desired, and where three of the strips are assembled into a star shape as shown in FIG. 7, retention of the assembly is firmer than with the single slit arrangement because of the multiplication of bands at the overlapping central connection, as visualized by the greater thickness in FIG. 9 as compared to FIG. 3, for example, effecting a tighter frictional binding connection. Because of this tighter connection it is somewhat more challenging to thread strip *a′* through the overlapping center bands 23 of the interconnected strips *b′* and *c′*, even though the slits 22 are slightly longer relative to the width of the strips than the single slits 20, in order to compensate for the more difficult and therefore more challenging assembly procedure required in the multi-slit arrangement.

Figure 11:
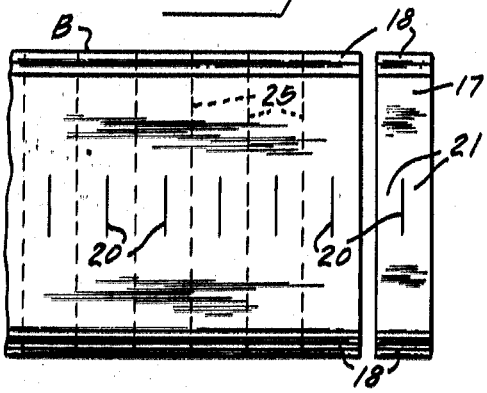
FIG. 11 is a fragmentary plan view of an extruded plastic blank section demonstrating how the strips for assembling the toy of FIG. 1 are adapted to be produced.
Figure 12:
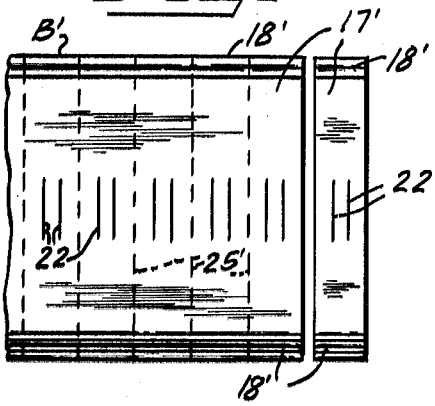
FIG. 12 is a fragmentary plan view of an extruded plastic blank section demonstrating how strips for assembling the toy of FIG. 7 are adapted to be produced.

FIGS. 11 and 12 represent steps in the manufacture of the strips 17 and 17′, respectively. In the manufacture of the strips 17, a continuous band B is extruded according to any preferred extrusion process, wherein the fasteners 18 are continuous stripes along the longitudinal edges of the band. At a suitable point after extrusion of the band B, the connection slits 20 are punched at successive suitable intervals. Thereafter, the band is severed along parallel transverse lines 25 intermediate the slits 20 to provide the individual strips 17. In similar fashion, the band B′ to produce the strips 17′ is extruded, the slits 22 are punched in the strip sections of the band, and then the band is successively separated along the lines 25′ into the individual strips 17′.

For purposes of merchandising the strips 17 or 17′, as the case may be, or mixtures of them, and if preferred mixtures of different colors of strips, a quantity of the strips may be packaged as, for example, in a container, bag or sack 27 which may be transparent to reveal the contents. The sack 27 may be of the plastic separable fastener closure-type having along the top opening snapped-together, pull-apart separable fastener means 28, with upper end pull-apart flange means having an aperture 29 by which the package is adapted to be hung on a display board or rack.

From the foregoing, it will be apparent that the present invention provides a unique toy capable of numerous and varied geometrical configuration embodiments wherein individual separably connected strips may be used individually, but may also be, and generally will be, connected into separably connective flexible toy assemblies which will provide two- or three-dimensional forms by connecting the same geometric toy configurations to one another, or by mixing various configurations in a builtup pattern. By selection of various colors for the basic toy configurations, monochromatic or multi-color basic toy configurations or units may be produced, and by provision of different colors in different of the configurations, varied color assemblies can be produced. The toy provides not only an interesting amusement device for pure pleasure, but also provides an educational device such as for various learning activities by providing manual dexterity training, perceptual differentiation training, artistic ability and imagination development. It may serve as a device for therapeutic activity. A very broad spectrum of utility is, therefore, indicated.

It will be understood that variations and modifications may be effected without departing from the spirit and scope of the novel concepts of this invention.

I claim as my invention:

1. A separably connective flexible toy, comprising:

a plurality of generally flat elongated flexible strips, each of which has complementary rib and groove fastener means at each opposite end;

each of said strips being bendable and twistable along its length, and said fastener ribs and grooves being interlockable with fastener ribs and grooves at the opposite end of the same strip or of another such strip; and at least one of said strips having a slit therein through which a second of said strips projects for retained generally crossing assembled relation with the slit strip.

2. A separably connective flexible toy according to claim 1, wherein said slit extends longitudinally in said first strip and is only slightly wider than said second strip, and said second strip projects through said slit transversely relative to the first strip.

3. A separably connective flexible toy according to claim 2, wherein said slit separates the area of said first strip along the strip into flat bands, said second strip being in flat face-to-face relation to said bands.

4. A separably connective flexible toy according to claim 1, wherein said second strip also has a slit therein, and a third strip projects through the slit in said one strip and through the slit in said second strip, said strips providing arms extending from the interconnection provided at the projection of the strips through the respective slits, said arms being substantially equally circumferentially spaced from one another, providing a generally star-shaped toy configuration.

5. A separably connective flexible toy according to claim 4, wherein said strips have connective bands along said slits, and said bands being in overlapping frictional pressure relationship maintaining the strips in substantially stable orientation in the toy configuration.

6. A separably connective flexible toy according to claim 2, wherein said first strip has a second slit parallel to and coextensive with said first mentioned slit, and said second strip projects through both of said slits transversely relative to the first strip.

7. A separably connective flexible toy according to claim 6, wherein said slits separate the area of said first strip along the slits into flat bands, said second strip being in flat face-to-face relation to said bands.

8. A separably connective flexible toy according to claim 6, wherein said second strip also has at least one slit therein, and a third strip projects through the slits in said one strip and through the slit in said second strip, said strips providing arms extending from the interconnection provided at the projection of the strips through the respective slits, said arms being substantially equally circumferentially spaced from one another, providing a generally star-shaped toy configuration.

9. A separably connective flexible toy according to claim 8, wherein said strips have connective bands along said slits, and said bands being in overlapping frictional pressure relationship maintaining the strips in substantially stable orientation in the toy configuration.

10. A separably connective flexible toy kit comprising a plurality of elongate generally flat flexible strips which are bendable and twistable along their length;

each of said strips having complementary fastener means at each opposite end interlockable with fastener means of another strip or of the same strip;

a plurality of the strips having slits therein through which others of the strips are projected, so that three of the strips are assembled together in a stable generally star-shaped toy configuration having generally radial arms and wherein each of the arms is bendable and twistable along its length;

and wherein a first strip projects through the slit in a second strip and then a third strip projects through the slits in the first and second strips.

11. A separably connective flexible toy kit according to claim 10, wherein said slits extend longitudinally and separate the slit areas of said first and second strips into coextensive bands between which said third strip is engaged flatwise.

12. A separably connective flexible toy kit according to claim 10, wherein said first strip has a pair of the slits in parallel substantially coextensive relation, and said second and third strips are received through both of said pair of slits.

13. A method of making a separably connective flexible toy, comprising:

manipulating a plurality of generally flat elongated flexible toy strips which are bendable and twistable along their length and each having at opposite ends thereof complementary rib and groove fastener means; and projecting at least one of the strips through a slit in at least a second of the strips and thereby assembling the strips into a generally crossing multi-arm relationship;

whereby the strip arms may be bent for interlocking the fastener ribs and grooves at the ends of the same strip with one another or with the fastener means of another strip.

14. A method according to claim 13 comprising projecting a third strip through the slit in the second strip and a similar slit in said one strip and thereby providing a generally star-shaped toy configuration.

15. A method according to claim 13, comprising punching slits at transverse strip intervals along a length of a plastic extrusion band having the complementary rib and groove fastener means formed along opposite longitudinal edges, and severing the extruded band along transverse lines between the slits to provide the flexible toy strips.

16. A method according to claim 15, comprising punching a single slit at each of said intervals so that each strip will have a single slit.

17. A method according to claim 15, comprising punching a pair of parallel substantially coextensive slits at each of said strip intervals along the extrusion band, whereby each of the severed strips will have a pair of the slits.

* * * * *